US005404778A

United States Patent [19]

Ward

[11] Patent Number: 5,404,778

[45] Date of Patent: Apr. 11, 1995

[54] CUTTING GUIDE

[75] Inventor: Jonathan Ward, Warwickshire, Great Britain

[73] Assignee: Duralay Limited, Great Britain

[21] Appl. No.: 752,563

[22] PCT Filed: Mar. 5, 1990

[86] PCT No.: PCT/GB90/00334

§ 371 Date: Jun. 1, 1992

§ 102(e) Date: Jun. 1, 1992

[87] PCT Pub. No.: WO90/10526

PCT Pub. Date: Sep. 20, 1990

[30] Foreign Application Priority Data

Mar. 7, 1989 [GB] United Kingdom ..... 89/05200

[51] Int. Cl.[6] ..... B26B 29/06

[52] U.S. Cl. ..... 83/49; 83/56; 83/467.1; 83/581; 83/648; 30/289

[58] Field of Search ..... 83/614, 821, 467.1, 83/468.1, 455, 581, 648, 745, 39, 49, 56; 30/289, 290, 293, 294; 33/526, 527; 269/289 R, 303

[56] References Cited

U.S. PATENT DOCUMENTS

| | | | |
|---|---|---|---|
| 3,768,357 | 10/1973 | McBride | 83/438 |
| 4,096,631 | 6/1978 | Ward | 30/294 |
| 4,505,039 | 3/1985 | Donovan | 30/289 |
| 4,646,439 | 3/1987 | Squires | 30/289 |

FOREIGN PATENT DOCUMENTS

| | | |
|---|---|---|
| 857840 | 1/1961 | United Kingdom . |
| 1408234 | 10/1975 | United Kingdom . |
| 2161411 | 1/1986 | United Kingdom . |

*Primary Examiner*—Eugenia Jones

[57] ABSTRACT

A guide for use in cutting carpet and a method of joining two portions of cut carpet in edge-to-edge relationship has a base formed as a lower portion and an upper portion interengaged through a longitudinal slideway and presenting an upper ramp surface. The upper portion has a longitudinal channel along which a knife blade can pass to cut a carpet portion laid on the ramp. The lower portion has a vertical wall vertically below the channel and against which the cut edge of first carpet portion is located to abut during cutting of the second carpet portion on the ramp so that when the guide is removed the two cut edges will fall into edge-to-edge abutment for joining together.

7 Claims, 1 Drawing Sheet

CUTTING GUIDE

The invention relates to a cutting guide and more particularly to a cutting guide for use in making a cut in a flexible sheet member, such as a carpet. The cutting guide is of especial value when a neat and tidy seam or joint is to be provided between two portions of carpet. The invention also extends to a method of using the guide.

BACKGROUND OF THE INVENTION

In my patent application PCT/GB 88/00805 Agents ref 2718 PCT, I have described and claimed a guide for use in making a cut in a flexible sheet member such as a carpet, the guide comprising a base having a substantially flat upper surface portion, an elongate channel to receive a cutting device such as the blade of a knife, extending adjacent the upper surface portion, the flexible sheet being arranged in use to overlie the upper surface portion and the channel, wherein an inner side wall of the channel extends at an oblique angle to the upper surface portion and the cutting device in use is urged towards that inner side wall to produce a cut which is at an oblique angle to the plane of the sheet.

When the guide is used to form a seam between two portions of carpet, skill is required by the user to ensure that the cut edges are parallel to one another and are correctly spaced apart, so that when the guide is removed, the cut edges fall together and abut each other.

It is one object of the invention to avoid or minimize that problem.

SUMMARY OF THE INVENTION

According to one aspect of the invention, there is provided a guide for use in making a cut in two flexible sheet members such as carpets which are to be placed in edge to edge contact, the guide comprising a base having a substantially flat upper surface portion, an elongate channel extending adjacent the upper surface portion to receive the blade of a cutting device such as a knife, a side wall of the channel being at an oblique angle to the upper surface portion, wherein a substantially vertical wall portion extends longitudinally along the base substantially in vertical alignment with, and parallel to the mouth of the channel.

Preferably the base comprises an upper and a lower portion which include releasable interengaging means so as to be movable relative to each other in the direction of their length, the upper surface portion and the channel are located on the upper base portion, and the vertical wall is located on the lower base portion.

In another aspect of the invention there is provided a method of joining two portions of carpet or like sheet material in side-by-side relationship comprising the steps of:

placing a guide according to the invention underneath the margin of the first portion of carpet;

inserting the blade of a knife in the channel and urging the blade towards the oblique inner side wall while drawing the knife along the channel;

discarding the marginal strip thereby provided;

turning the guide about 180° and placing the vertical wall portion adjacent the cut edge of the first carpet portion;

placing the margin of the second portion of carpet over the channel, inserting the blade therein, drawing it therealong and discarding the marginal strip thereby produced;

removing the guide and allowing or causing the two cut edges to fall together;

adhering the cut edges to the floor or otherwise joining them together.

In this way, the lower base may be retained adjacent a cut edge of the first portion of carpet while the upper base portion is moved along underneath the second portion of carpet to thereby ensure that the cut edges always remain parallel to one another.

BRIEF DESCRIPTION OF THE DRAWINGS

In order that the invention may be better understood it will now be described with reference to the accompanying diagrammatic drawings in which.

DETAILED DESCRIPTION OF THE PREFERRED EMBODIMENT

Figure 1:
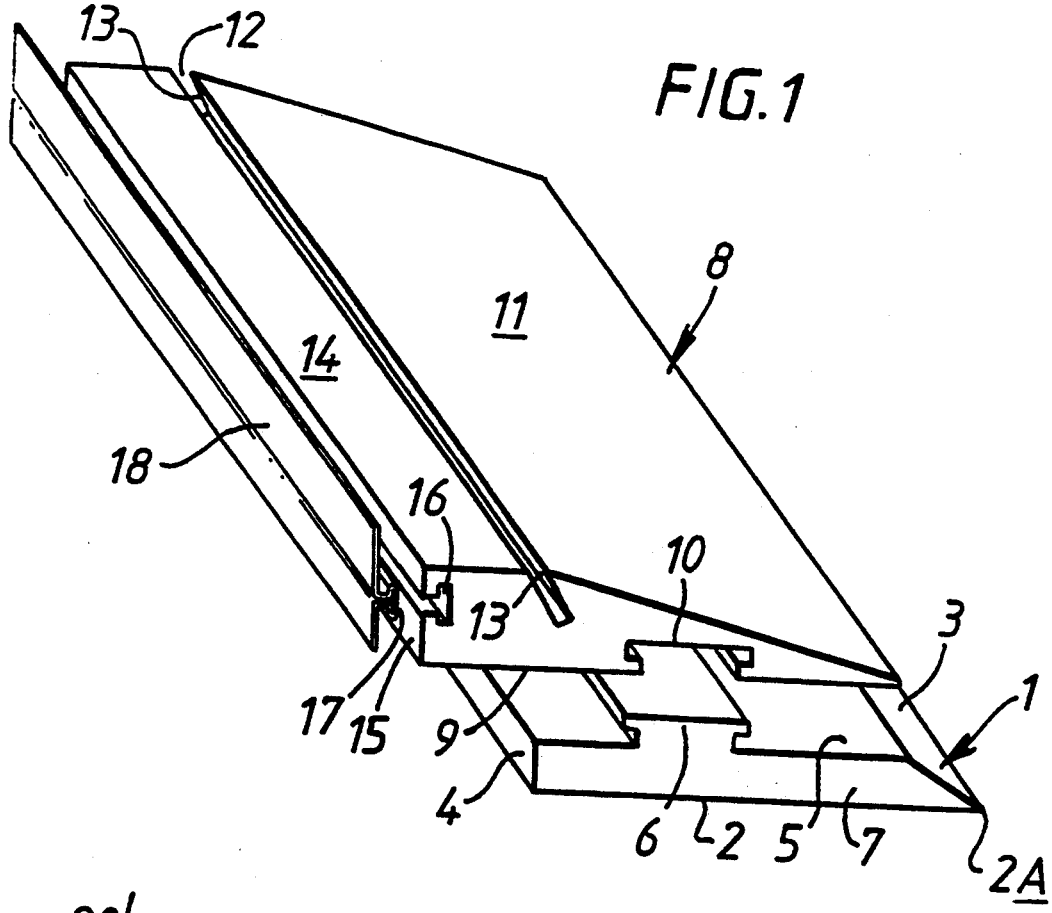
FIG. 1 is a perspective exploded view of a cutting guide of the invention.
Figure 2:
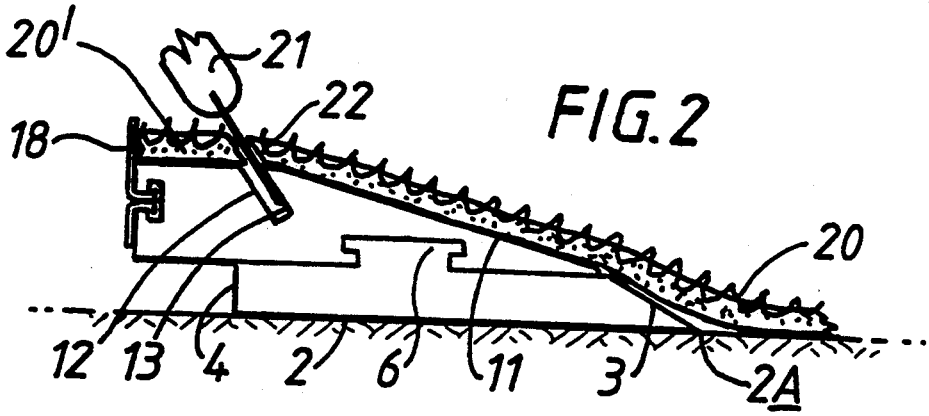
FIG. 2 is an end view of the guide of FIG. 1 at a stage of use.

In FIG. 1 a cutting guide comprises an elongate lower base portion 1 having a substantially flat underside 2. One longer side of the lower base 1 defines a ramp portion 3 which is inclined upwardly from one side edge 2A of the base 1. The opposing side of the base defines a vertical wall 4. The upper surface 5 of the base 1 is generally parallel to the underside 2, but is formed with an integral rail 6 which extends along the length of the base 1 and is generally of a broad "T"-shape in cross-section. The end face 7 of the lower base 1 may include interlocking lugs (not shown), whereby a plurality of such bases 1 may be placed in end-to-end relation, so as to extend the length of the track 6.

An elongate upper guide portion 8 overlies the lower base portion 1 and has a substantially flat underside 9 including a slot 10 which is of a generally "T"-shaped section and which is complementary to the rail 6 on the lower base 1. The upper portion 8 includes a side ramp portion 11 on the upper surface which is inclined upwardly from one side. A channel 12 extends along the base 8, at the top of the ramp 11 parallel to the edge 2A. The channel 12 includes an inner side wall 13 which is inclined at an oblique angle to the adjacent ramp portion 11. The upper and lower base portions 1, 8 are dimensioned so that when the rail 6 is received in the slot 10 to form a longitudinal slideway, the vertical wall portion 4 lies "vertically" (see the comments herein after) below the mouth of the channel 12 with which it is parallel. The upper surface 14 of the upper base 8 beyond the channel 12 is horizontal and ends in a vertical side wall 15. The side wall 15 defines an inwardly extending "T"-shaped slot 16 to receive a complimentary "T"-shaped extension 17 of a stop 18 or upstanding side wall which extends above the level of the upper surface 14. Each base portion 1, 8 may be formed as an extrusion from aluminium or like alloy, or may be formed from plastics material.

Figure 3:
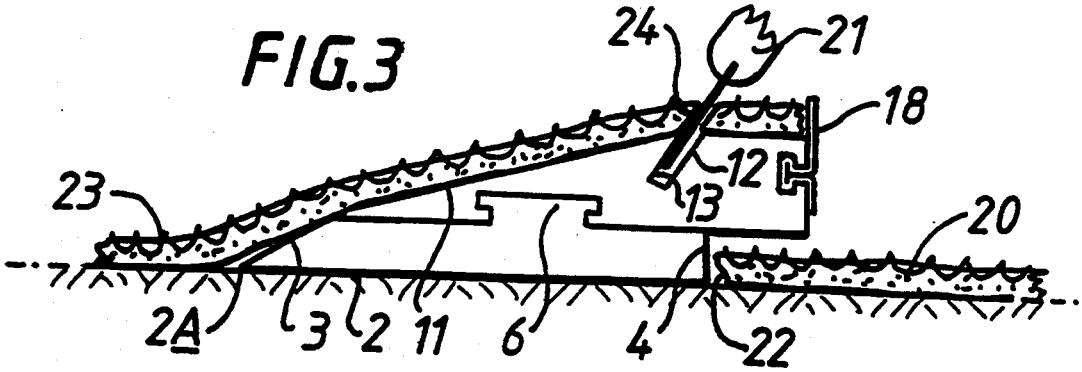
FIG. 3 is the same as FIG. 2 at a further stage of use.

In use of the guide, the upper portion 8 is slid into position above the lower base 1 and the stop 18 is fixed in the slot 16. The guide is then placed underneath the margin of the first piece of carpet 20 to be joined, with the free edge in contact with the stop 18. The blade of a knife 21 is inserted in the channel 12 and urged towards the oblique side wall 13. The knife 21 is drawn along the channel 12 to cut off the margin of the carpet 20. In the case where a plurality of lower bases 1 are joined end to end, the upper base 8 may be periodically moved along the slideway formed between the 6 and slot 10 and relative to the lower base 1, as the cut is made. The margin is then discarded. The guide is then turned about through 180°, to the condition shown in FIG. 3, and the vertical wall 4 placed against the cut edge 22 of the first portion of the carpet 20. The second portion 23 of the carpet to be joined is then lain over the channel 11 with the edge thereof in contact with the stop 18. The blade of the knife is then inserted in the channel and drawn therealong as before, to produce a cut edge 24. The margin thereby produced is discarded. Because the vertical wall 4 is "vertically" (see below) beneath the mouth of the channel 12, once the guide has been removed, the two cut edges 22, 24 fall together in abutting edge to edge contact. It will be appreciated from the foregoing that for the two cut edges 22 and 24 to fall together in abutting edge to edge contact, the length of the carpet 23 extending over the ramped surfaces 3 and 11 to its cut edge 24 should substantially correspond to the width of the underside 2 of the base portion 1. Consequently to allow for the ramps 3 and 11, the mouth of the channel 12 will be offset from vertical alignment with the wall 4 and located slightly closer (in a horizontal plane) to the longitudinal edge 2A formed between the ramp 3 and underside surface 2 then the horizontal spacing between that longitudinal edge 2A and the wall 4. In practice this difference in horizontal spacing is likely to be extremely small so that the mouth of the channel 12 may be considered as being substantially in vertical alignment with the wall 4; for example in a practical embodiment the overall height of the base 1 and guide portion 8 (fitted thereto through the slideway) may be 13 millimeters with the ramps 3 and 11 subtending an angle of approximately 20° with the underside face 2 and for the cut carpet portions to fall together with their edges 22 and 24 in abutment, the mouth of the channel 12 may be offset as aforementioned by approximately 1.5 millimeters out of absolute vertical alignment with the wall 4. Consequently the spacing from the edge 2A over the profile of the ramped surfaces 3 and 11 to the channel 12 is substantially the same as the spacing from the edge 2A over the flat underside surface 2 to the vertical wall 4. The two cut edges 22, 24 may be adhered to the floor or otherwise attached together.

The invention is not limited to the embodiment shown. For example, the cutting device may be integrally formed with the base.

I claim:

1. A method of joining two flexible sheet members in side-by-side relationship by providing a guide which has a base comprising an upper base portion and a lower base portion and a substantially flat underside surface on the lower base portion, the lower base portion having a longitudinally extending wall which is spaced from and parallel with a longitudinally extending edge of said underside surface and which wall, when said underside surface is horizontal, extends upwardly from the underside surface, the base having an upper surface portion which overlies the underside surface and presents a ramp that extends from said edge of the underside surface and subtends an acute angle with said underside surface, the upper surface portion having a longitudinally extending cutting guide edge which extends parallel to said wall and is formed by a channel in the upper base portion, the wall being spaced from said edge of the underside surface over the underside surface substantially the same distance as the guide cutting edge is spaced over the upper surface portion from said edge of the underside surface, and the upper base portion being movable relative to the lower base portion in the longitudinally direction of the channel, and wherein the method comprises placing said guide underneath a margin of a first said sheet member such that said first sheet member to lies on the upper surface portion over the channel in the upper base portion; inserting a knife blade in said channel and drawing the blade along the guide edge of the channel to provide a cut edge to said first sheet member, moving the upper base portion relative to the lower base portion in the longitudinal direction of the channel to translate the channel and guide edge beneath the first sheet member and drawing the knife blade along the so translated guide edge to extend said cut edge to the first sheet member and discarding a marginal strip cut from said first sheet member; turning the guide about 180° and placing said upstanding wall that extends from the underside surface adjacent to said cut edge of the first sheet member; placing a margin of a second said sheet member to lie on the upper surface portion over the channel and inserting said knife blade in the channel and drawing the blade along the guide edge of the channel to provide a cut edge for said second sheet member, moving the upper base portion relative to the lower base portion in the longitudinal direction of the channel to translate the channel and guide edge beneath the second sheet member and drawing the knife blade along the so translated guide edge to extend said edge to the second sheet member and discarding a marginal strip cut from said second sheet member, and removing the guide so said cut edges of the first and second sheet members move into edge-to-edge contact.

2. A guide for use in making a cut in a flexible sheet member to form an edge of said member for two of said members to be placed in side-by-side and edge-to-edge contact relationship, said guide comprising a base having an upper base portion and a lower base portion and a substantially flat underside surface on the lower base portion; said lower base portion having a longitudinally extending wall which is spaced from and parallel with a longitudinally extending edge of said underside surface, said wall extending upwardly from said underside surface; said upper base portion having an upper surface portion which overlies the underside surface and defines a ramp that extends from said edge of the underside surface and subtends an acute angle with said underside surface, said upper surface portion defining a longitudinally extending cutting guide edge that extends parallel to said wall, said cutting guide edge defined by a channel in the upper base portion; said wall being spaced from said edge of the underside surface over said underside surface substantially by the same distance as the cutting guide edge is spaced over the upper surface portion from said edge of the underside surface, whereby with an edge of a first said sheet member abutting said wall, a second said sheet member laid on the upper surface portion to overlay the channel has an edge cut along said cutting guide edge by a knife blade received within and moving longitudinally along said channel so that when the guide is removed the said edges of the first and second sheet member lay flat and in edge-to-edge contact, and said upper base portion being movable longitudinally relative to the lower base portion to thereby extend the length of a cut which is formed in the sheet member along the cutting guide edge.

3. A guide as claimed in claim 2 in which the cutting guide edge is defined by a side wall of the channel which channel side wall is located adjacent to the upper surface portion and is inclined at an oblique angle relative thereto.

4. A guide as claimed in claim 2 further comprising a side wall stop surface provided upstanding from the upper surface portion and spaced from and parallel with the cutting guide edge and against which an edge of a said sheet member laying on the upper surface portion abuts during cutting thereof.

5. A guide as claimed in claim 4 in which said side wall stop surface upstanding from the upper surface portion is removably attached to the upper base portion.

6. A guide as claimed in claim 2 wherein slideway means is provided between said upper and lower base portions for said base portions to be slidably movable longitudinally relative to each other.

7. A guide as claimed in claim 2 in which the upper base portion is releasably engaged with the lower base portion.

* * * * *

UNITED STATES PATENT AND TRADEMARK OFFICE

CERTIFICATE OF CORRECTION

PATENT NO. : 5,404,778

DATED : April 11, 1995

INVENTOR(S) : Jonathan Ward

It is certified that error appears in the above-identified patent and that said Letters Patent is hereby corrected as shown below:

Column 4, lines 6 and 7, "longitudinally" should be --longitudinal--;

Column 4, line 10, delete "to".

Signed and Sealed this

Fifteenth Day of August, 1995

*Attest:*

*Attesting Officer*

BRUCE LEHMAN

*Commissioner of Patents and Trademarks*